US006409407B1

(12) United States Patent
Schweizer

(10) Patent No.: US 6,409,407 B1
(45) Date of Patent: Jun. 25, 2002

(54) PEN OR PENCIL

(75) Inventor: Manfred Schweizer, Eckental (DE)

(73) Assignee: Schwan-STABILO Schwanhausser GmbH & Co., Heroldsberg (DE)

( * ) Notice: Subject to any disclaimer, the term of this patent is extended or adjusted under 35 U.S.C. 154(b) by 0 days.

(21) Appl. No.: 09/889,544

(22) PCT Filed: Jul. 11, 2000

(86) PCT No.: PCT/EP00/06574

§ 371 (c)(1),
(2), (4) Date: Jul. 18, 2001

(87) PCT Pub. No.: WO01/03946

PCT Pub. Date: Jan. 18, 2001

(30) Foreign Application Priority Data

Jul. 12, 1999 (DE) ..... 199 32 460

(51) Int. Cl.[7] ..... B43K 5/12
(52) U.S. Cl. ..... 401/192; 4/194; 362/118
(58) Field of Search ..... 401/192, 194, 401/195, 52; 362/118

(56) References Cited

U.S. PATENT DOCUMENTS

| | | | | | |
|---|---|---|---|---|---|
| D31,072 | S | * | 6/1899 | Tucker | D19/50 |
| 3,764,064 | A | * | 10/1973 | Gaidos et al. | 235/70 D |
| D231,408 | S | * | 4/1974 | Jenkins | D19/54 |
| D359,307 | S | * | 6/1995 | Anavil et al. | D19/50 |
| 5,915,871 | A | * | 6/1999 | Kobayashi et al. | 401/213 |
| 5,984,556 | A | * | 11/1999 | Gray et al. | 401/192 |
| 6,217,245 | B1 | * | 4/2001 | El-Fakir et al. | 401/195 |

* cited by examiner

*Primary Examiner*—Gregory L. Huson
*Assistant Examiner*—Huyen Le
(74) *Attorney, Agent, or Firm*—Bachman & LaPointe, P.C.

(57) ABSTRACT

A pen or pencil having a shaft which in its peripheral surface has at least one first and at least one second surface region. Irradiation of the first surface region with light of a first light quantity per unit of surface area results in an emission of visible light in the second surface region, wherein the light quantity emitted in the second surface region per unit of surface area for at least one first frequency is greater than the light quantity per unit of surface area of the first frequency, which is absorbed in the first surface region.

13 Claims, 1 Drawing Sheet

Fig. 1
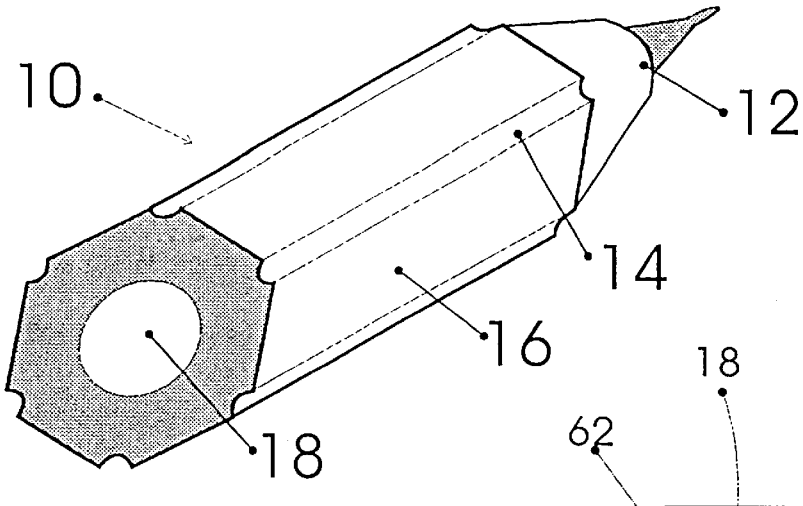
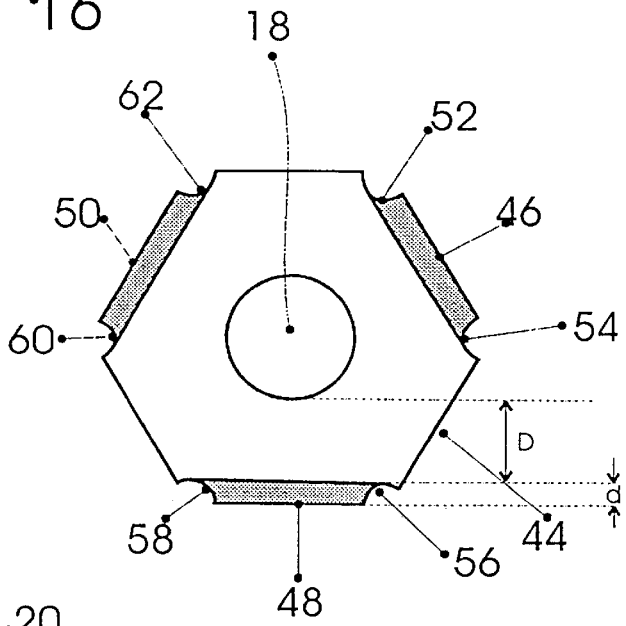
Fig. 3
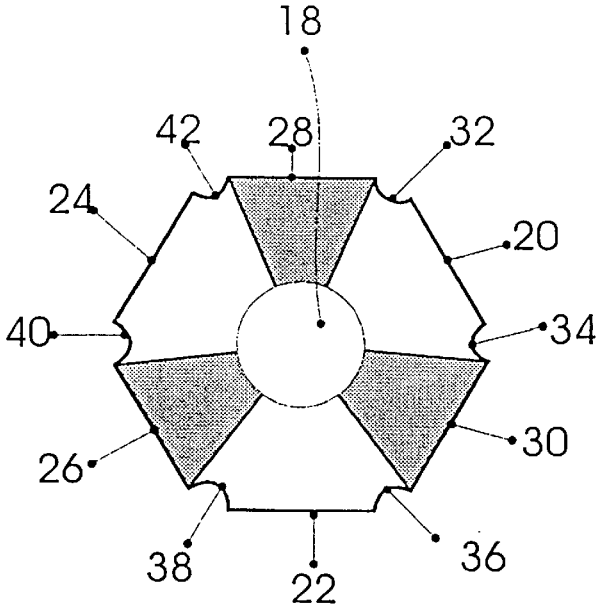
Fig. 2

PEN OR PENCIL

BACKGROUND OF THE INVENTION

The invention concerns a pen or pencil comprising a shaft which in its peripheral surface has at least one first and at least one second surface region.

Pens or pencils of the kind set forth above are known. If such pens or pencils are to be individualized, the two surface regions referred to above serve for that purpose. More specifically, if they are suitably arranged and if they are optically different from each other, they can serve for individualization purposes. In that respect, it can not only be provided that for example the second surface region is in the form of script. On the contrary, it can also be in the form of a pattern such as for example longitudinal stripes (for example at longitudinal edges).

In the case of known pens or pencils, the second surface region is frequently formed by being raised or recessed with respect to the first surface region. That admittedly achieves an optical effect. Frequently however that optical effect is not sufficiently clear-cut and striking, so that it can be easily overlooked. Another option in regard to an optically different configuration as between the first and second surface regions provides that a shaft which is of a first color is covered in a portion-wise manner with a layer or coating of a second color, in order to form the second surface region. With that arrangement however problems arise in particular when the second surface region is raised with respect to the first surface region or is disposed for example in the region of the above-mentioned edges, because in that case the colored layer all too easily wears away in use.

An object of the present invention is to design a pen or pencil of the kind set forth in the opening part of this specification, in such a way that the second surface region can be optically easily distinguished from the first surface region, but nonetheless the risk of wearing away does not occur.

SUMMARY OF INVENTION

In accordance with the invention, the specified object is attained in that irradiation of the first surface region with light of a first light quantity per unit of surface area results in an emission of visible light in the second surface region (which is adjacent to the first surface region), wherein the light quantity emitted in the second surface region per unit of surface area for at least one first frequency is greater than the light quantity per unit of surface area of the first frequency, which is absorbed by the first surface region.

In other words, the light impinging on the second surface region is not simply reflected, as in the case of the coating of a different color for forming the second surface region, but that light which impinges on the first surface region is used for optical distinguishability of the second surface region.

As accordingly light is not (only) reflected in the second surface region but radiates out from the interior, the second surface region has a "fluorescing" action, whereby it can be optically readily distinguished from the first surface region.

As a coating which differs in color from the first surface region is not required for the second surface region, there is also no danger of it being worn away, more specifically not even if the second surface region should be raised with respect to the first surface region.

In principle, in accordance with the invention, it is possible to use any mechanisms in order to cause the second surface region to "light up"in response to light shining on the first surface region. In accordance with the invention however it is preferred that the first surface region is the outside of a translucent part of the shaft, which includes a light-collecting substance, wherein the light-collecting substance receives the light shining on the first surface region and light emitted by the light-collecting substance issues from the shaft at least in part in the second surface region.

That design configuration is technically particularly simple to implement.

As already mentioned above, in accordance with the invention the shaft may have at least one longitudinal edge which at least partially coincides with the second surface region. In other words, in that way it is possible to provide a pen or pencil which has at least one "lighting-up" longitudinal edge, wherein that lighting-up effect is maintained even if the edge should be knocked off.

In order further to protect the longitudinal edge and to increase the lighting-up effect, it can be provided in accordance with the invention that it is in the shape of a concave groove or channel.

In accordance with a particularly preferred embodiment of the invention the shaft, in regard to its cross-section, involves the outside contour of a polygon, the corners of the polygon each coinciding with a respective longitudinal edge. In other words, the invention in this embodiment provides a pen or pencil with a plurality of "lighting-up"longitudinal edges.

For the purposes of further simplification, it can be provided in accordance with the invention that at least one surface region of the shaft, which is between two longitudinal edges, does not coincide with the first surface region. In other words, in that configuration of the invention, light for the "lighting-up" edge strips is not collected in each region between two edge strips. That can provide a saving in terms of production and material costs.

Thus it can be provided for example that the shaft has an even number of longitudinal edges and only each second surface region which is between two longitudinal edges coincides with the first surface region. Therefore—as viewed in the peripheral direction—light-absorbing and non-light-absorbing regions are disposed alternately. As however each longitudinal edge is adjacent to a light-absorbing region, each longitudinal edge can also be fed for "lighting up".

In accordance with an embodiment of the invention it is provided that the part of the shaft, which includes the light-collecting substance, extends as viewed in a radial direction over the entire thickness of the shaft. In other words, in this embodiment the shaft material is used in its entire depth for "feeding" the second surface region.

As an alternative thereto, it can be provided that the part of the shaft which includes the light-collecting substance extends as viewed in the radial direction only over the outer 10%, preferably 5%, more preferably 2%, of the thickness of the shaft. This design configuration of the invention is based on the realization that the light-collecting substance has to be used only as far as a certain "penetration depth" of the light for feeding the second surface region and that—with the usual pen or pencil dimensions—a comparatively small proportion of the total available shaft is already sufficient to adequately feed the second surface region.

In accordance with the invention the light-collecting substance is preferably Oracet Yellow 8GF (Solvent Yellow 145) and/or Oracet Pink RF (Pigment Red 181).

The shaft can be in the form of a sleeve or tube, the internal space of which serves as a storage means for the writing substance. In particular, when the shaft overall is transparent, it is possible to see the level of filling of the writing substance storage means, through the shaft. As the second surface regions are not formed by colored coatings, it is also possible to see unimpededly through them and it is therefore always reliably possible to see the level of filling of the storage means, even if the second surface region is comparatively large. It is expressly pointed out that the internal space of the sleeve or tube is considered as a storage means in accordance with the invention, even if it accommodates a pencil lead, a ballpoint cartridge or refill, etc.

Preferably in accordance with the invention it is provided that the shaft is of plastic material, preferably polypropylene, polyester, polyacrylate, polymethylmethacrylate, polycarbonate, polyamide, polyacetate, polyacetal, polystyrene and/or a combination of polystyrene with a polystyrene/butadiene copolymer. Out of the specified plastic materials, it is also possible for various types to be mixed or combined with each other, for example types involving different molecular chain lengths. The choice of the plastic material or the plastic material mix depends inter alia on whether it is to include the light-collecting substance and whether it is to come into contact with the writing substance. Thus for example polypropylene is admittedly not sufficiently transparent, but on the other hand it is best suited to forming the writing substance storage means, more specifically because of its best compatibility with all kinds of known writing substances, including water-based and alcohol-based writing materials.

As accordingly under some circumstances different plastic materials are to be provided on the one hand for receiving the light-collecting substance and on the other hand for forming the writing fluid storage means, it is particularly preferred in accordance with the invention for the shaft to be produced by co-extrusion of two or more plastic materials. That means that various regions of the shaft (for example a region with the light-collecting substance and another region for forming the storage means for the writing substance) do not have to be produced separately and then assembled by adhesive or the like. If different plastic materials are co-extruded, they should have comparable melting ranges and comparable shrinkage characteristics.

BRIEF DESCRIPTION OF THE DRAWINGS

The invention will be described in greater detail hereinafter by means of preferred embodiments with reference to the accompanying drawing in which:

FIG. 1 is a perspective sectional view of a pen or pencil in accordance with a first embodiment of the invention, and FIGS. 2 and 3 are sectional views of further embodiments of the invention.

DETAILED DESCRIPTION OF THE INVENTION

Referring to FIG. 1, a pen or pencil has a shaft 10 and a writing tip 12 (which is only diagrammatically shown). In cross-section, the shaft 10 is of a substantially hexagonal outside contour. Formed at each of the corners of the hexagon are respective longitudinal edges of which one is representatively identified by reference numeral 14. It (like also the other longitudinal edges) is in the shape of a concave channel or groove. The shaft 10 is of transparent polystyrene. Added to the polystyrene is a light-collecting dye, more specifically Oracet Yellow 8GF (Solvent Yellow 145).

Disposed adjacent to the longitudinal edge 14 is a surface region which is identified by reference numeral 16.

The shaft 10 is internally hollow, the hollow space identified by reference numeral 18 serving as a storage means for the writing substance, being an alcohol-based writing material in the illustrated example. At this point it should be noted that polystyrene is excellently well suited for providing a storage space for alcohol-based writing materials.

Light which impinges on the first surface region 16 penetrates into the shaft 10 by virtue of the transparency of the polystyrene, and in the shaft 10 impinges on pigments of the light-collecting substance. Because of the given geometries involved, reflection phenomena of the light emitted by the light-collecting substance occur to an increased degree at the second surface 16 and at the inside surface of the shaft 10, whereas reflection phenomena scarcely occur at the surface of the channel-shaped longitudinal edge 14. The light emitted by the light-collecting substance will therefore preferably issue in the region of the adjacent longitudinal edge 14, for which reason the shaft 10 "lights up" from the channel-shaped longitudinal edge 14 when light shines on the first surface region 16.

That accordingly affords the optical impression that light passes into the shaft 10 by way of the first surface region 16 and issues again from the channel-shaped longitudinal edge 14 which is directly adjacent to the first surface region 16.

As there is no need to provide a colored applied coating for the purposes of forming the second surface region (channel-shaped longitudinal edge 14) which "lights up" and which is therefore optically different from the first surface region 16, the production process is correspondingly simplified. In addition the longitudinal edge which "lights up" is "abrasion-resistant", in contrast to a colored coating in the edge region.

The embodiment shown inn FIG. 2 differs from that illustrated in FIG. 1 in that it is not the entire shaft that comprises plastic material including light-collecting substance. On the contrary, light-collecting substance (Oracet Yellow 8GF (Solvent Yellow 145)) is to be found only in segments 26, 28 and 30 whereas segments 20, 22 and 24 do not include any light-collecting substance. As however the channel-shaped longitudinal edges 32, 34, 36, 38, 40 and 42 are respectively adjacent to the segments 20, 22 and 24 with light-collecting substance, a lighting effect nonetheless occurs at all longitudinal edges.

The described segments are produced by a co-extrusion procedure, which is advantageous over a production process in which the segments are individually produced and then assembled (for example by adhesive).

In comparison with the embodiment shown in FIG. 1, the embodiment of FIG. 2 requires less plastic material containing light-collecting substance. The base material of all segments is however also polystyrene in FIG. 2.

In the embodiment shown in FIG. 3 the shaft is again divided into a plurality of portions, in this case however not into comparable segments, but into a main body 44 of polystyrene and outer layers 46, 48 and 50 comprising a polystyrene/butadiene copolymer, wherein the outer layers contain the light-collecting substance, in this case Oracet Pink RF (Pigment Red 181).

As can be seen from FIG. 3, longitudinal edges 52, 54, 56, 58, 60 and 62 in the form of concave channels are respectively provided at each of the outer layers 46, 48 and 50 so that they are disposed immediately adjacent outer surfaces of the outer layers 46, 48 and 50, those surfaces serving as first surface regions.

As is already the case in the embodiments shown in FIGS. 1 and 2, light which penetrates into the outer layers 46, 48 and 50 will impinge on pigments contained therein of the light-collecting substance. The light emitted by the pigments of the light-collecting substance will in turn issue predominantly in the region of the channel-shaped longitudinal edges 52, 54, 56, 58, 60 and 62, because of the geometries involved, thus giving rise to a "lighting-up effect".

In the embodiment of FIG. 3, the outer layers 46, 48 and 50 comprising the polystyrene/butadiene copolymer are co-extruded by co-extrusion with the main body 44 of polystyrene, which does not give rise to any problems because of comparable melting ranges and comparable shrinkages characteristics.

The view shown in FIG. 3 is not true to scale. More specifically, in actual fact the thickness d of the outer layers 46, 48 and 50 is only about 2% of the thickness D of the main body. In this embodiment of the invention accordingly only very little plastic material containing light-collecting substance is required in order to cause the longitudinal edges to "light up".

The features of the invention disclosed in the foregoing description, the claims and the drawing can be essential both individually and also in any combinations for carrying the invention into effect in its various embodiments.

What is claimed is:

1. A pen or pencil comprising a writing tip end a shaft (10) which in its peripheral surface has at least one first (16) and at least one second (14) surface region, characterized in that irradiation of the first surface region (16) with light of a first light quantity per unit of surface area results in an emission of visible light in the second surface region (14), wherein the light quantity emitted in the second surface region (14) per unit of surface area for at least one first frequency is greater than the light quantity per unit of surface area of the first frequency, which is absorbed in the first surface region (16).

2. A pen or pencil as set forth in claim 1 characterized in that the first surface region (16) is the outside of a translucent part (20, 22, 24; 46, 48, 50) of the shaft (10), which includes a light-collecting substance, wherein the light-collecting substance absorbs light shining on the first surface region (16) and light emitted by the light-collecting substance issues from the shaft (10) at least in part in the second surface region (14; 32, 34, 36, 38, 40, 42; 52, 54, 56, 58, 60, 62).

3. A pen or pencil as set forth in claim 2 characterized in that the part (20, 22, 24) of the shaft (10), which includes the light-collecting substance, extends as viewed in the radial direction over the entire thickness of the shaft (10).

4. A pen or pencil as set forth in one of claim 2 characterized in that the part (46, 48, 50) of the shaft (10) which includes the light-collecting substance extends as viewed in the radial direction only over the outer 10%, preferably 5%, more preferably 2%, of the thickness (D) of the shaft (10).

5. A pen or pencil as set forth in claim 2 characterized in that the light-collecting substance is Oracet Yellow 8GF (Solvent Yellow 145) and/or Oracet Pink RF (Pigment Red 181).

6. A pen or pencil as set forth in claim 1 characterized in that the shaft (10) has at least one longitudinal edge (14; 32, 34, 36, 38, 40, 42; 52, 54, 56, 58, 60, 62) which at least partially coincides with the second surface region.

7. A pen or pencil as set forth in claim 6 characterized in that the longitudinal edge (14; 32, 34, 36, 38, 40, 42; 52, 54, 56, 58, 60, 62) is in the form of a concave channel.

8. A pen or pencil as set forth in claim 6 characterized in that in cross-section the shaft (10) is of the outside contour of a polygon, wherein the corners of the polygon each coincide with a respective longitudinal edge (14; 32, 34, 36, 38, 40, 42; 52, 54, 56, 58, 60, 62).

9. A pen or pencil as set forth in claim 8 characterized in that at least one surface region of the shaft, which is between two longitudinal edges (42, 32), does not coincide with the first surface region (16).

10. A pen or pencil as set forth in claim 8 characterized in that the shaft (10) has an even number of longitudinal edges (14; 32, 34, 36, 38, 40, 42; 52, 54, 56, 58, 60, 62) and only each second surface region which is between two longitudinal edges (14; 32, 34, 36, 38, 40, 42; 52, 54, 56, 58, 60, 62) coincides with the first surface region (16).

11. A pen or pencil as set forth in claim 1 characterized in that the shaft (10) is in the form of a tube whose internal space (18) serves as a storage means for a writing substance.

12. A pen or pencil as set forth in claim 1 characterized in that the shaft (10) is of plastic material, preferably polypropylene, polyester, polyacrylate, polymethylmethacrylate, polycarbonate, polyamide, polyacetate, polyacetal, polystyrene and/or a combination of polystyrene with a polystyrene/butadiene copolymer.

13. A pen or pencil as set forth in claim 12 characterized in that the shaft (10) is produced by co-extrusion of two or more plastic materials.

* * * * *

UNITED STATES PATENT AND TRADEMARK OFFICE

CERTIFICATE OF CORRECTION

PATENT NO. : 6,409,407 B1
DATED : June 25, 2002
INVENTOR(S) : Manfred Schweizer

It is certified that error appears in the above-identified patent and that said Letters Patent is hereby corrected as shown below:

Column 5,
Line 26, delete “end” and insert -- and --.

Column 6,
Line 3, delete “one of”.

Signed and Sealed this

Nineteenth Day of November, 2002

*Attest:*

*Attesting Officer*

JAMES E. ROGAN
*Director of the United States Patent and Trademark Office*